US008278815B2

(12) United States Patent
Pan et al.

(10) Patent No.: US 8,278,815 B2
(45) Date of Patent: Oct. 2, 2012

(54) FIELD EMISSION LIGHT EMITTING DEVICE INCLUDING AN EMITTER WITHIN A NANOCHANNEL IN A DIELECTRIC MATRIX

(75) Inventors: David H. Pan, Rochester, NY (US); Fa-Gung Fan, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/189,357

(22) Filed: Jul. 22, 2011

(65) Prior Publication Data

US 2011/0279013 A1 Nov. 17, 2011

Related U.S. Application Data

(62) Division of application No. 12/134,361, filed on Jun. 6, 2008, now Pat. No. 8,007,333.

(51) Int. Cl.
*H01J 1/62* (2006.01)
*H01J 63/04* (2006.01)
*H01J 9/00* (2006.01)

(52) U.S. Cl. ..... 313/495; 313/496; 313/309; 313/310; 445/24

(58) Field of Classification Search ..... 313/495–497
See application file for complete search history.

(56) References Cited

U.S. PATENT DOCUMENTS 6,630,772 B1 10/2003 Bower et al.
6,858,981 B2 2/2005 Cho et al.
7,102,278 B2 9/2006 Oh et al.
7,189,435 B2 3/2007 Tuominen et al.
7,221,087 B2 * 5/2007 Liu et al. ..... 313/497
7,239,076 B2 7/2007 Lee et al.
2002/0055239 A1 5/2002 Tuominen et al.
2002/0079802 A1 6/2002 Inoue et al.
2005/0067935 A1 * 3/2005 Lee et al. ..... 313/309
2005/0179398 A1 * 8/2005 Onishi ..... 315/169.2
2006/0244357 A1 11/2006 Lee
2006/0261725 A1 * 11/2006 Lee ..... 313/495
2006/0267476 A1 11/2006 Jeon et al.
2009/0051853 A1 2/2009 Thomas et al.
2009/0051863 A1 2/2009 Meisner
2009/0224680 A1 9/2009 Pan

OTHER PUBLICATIONS

Park, Miri et al., "Large area dense nanoscale patterning of arbitrary surfaces", Applied Physics Letters, vol. 79, No. 2, Jul. 9, 2001, pp. 257-259.

Thurn-Albrechet et al., "Utrahigh-Density Nanowire Arrays Grown in Self-Assembled Diblock, Copolymer Templates", Science, 290, 2000, pp. 2126-2129.

* cited by examiner

*Primary Examiner* — Sikha Roy
(74) *Attorney, Agent, or Firm* — MH2 Technology Law Group LLP

(57) ABSTRACT

In accordance with the invention, there are field emission light emitting devices and methods of making them. The field emission light emitting device can include a plurality of spacers, each connecting a substantially transparent substrate to a backing substrate. The device can also include a plurality of pixels, wherein each of the plurality of pixels can include one or snore first electrodes disposed over the substantially transparent substrate, a light emitting layer disposed over each of the one or more first electrodes, and one or more second electrodes disposed over the backing substrate, wherein the one or more second electrodes and the one or more first electrode are disposed at a predetermined gap in a low pressure region. Each of the plurality of pixels can further include one or more nanocylinder electron emitter arrays disposed over each of the one or more second electrodes.

13 Claims, 8 Drawing Sheets

FIELD EMISSION LIGHT EMITTING DEVICE INCLUDING AN EMITTER WITHIN A NANOCHANNEL IN A DIELECTRIC MATRIX

RELATED APPLICATIONS

This application is a divisional of U.S. application Ser. No. 12/134,361, filed Jun. 6, 2008, the disclosure of which is incorporated herein by reference in its entirety. This application also relates to U.S. patent application Ser. No. 12/041,870, filed Mar. 4, 2008, now U.S. Pat. No. 7,990,068, the disclosure of which is hereby incorporated by reference in its entirety.

FIELD OF THE INVENTION

The present invention relates to light emitting devices and more particularly to field emission light emitting devices and methods of forming them.

BACKGROUND OF THE INVENTION

A field emission display is a display device in which electrons are emitted from a field emitter arranged in a predetermined pattern including cathode electrodes by forming a strong electric field between the field emitter and at least another electrode. Light is emitted when electrons collide with a fluorescent or phosphorescent material coated on an anode electrode. A micro-tip formed of a metal such as molybdenum (Mo) is widely used as the field emitter. A new class of carbon nanotubes (CNT) electron emitters are now being actively pursued for use in the next generation field emission device (FED), There are several methods of forming a CNT emitter, but they all suffer from general problems of fabrication yield, light emitting uniformity, and lifetime stability because of difficulty in organizing the CNT emitters consistently.

Accordingly, there is a need for developing a new class of field emission display devices and methods of forming them.

SUMMARY OF T HE INVENTION

In accordance with various embodiments, there is a field emission light emitting device. The field emission light emitting device can include a substantially transparent substrate and a plurality of spacers, wherein each of the plurality of spacers connects the substantially transparent substrate to a backing substrate. The field emission light emitting device can also include a plurality of pixels, each of the plurality of pixels separated by one or more spacers, wherein each of the plurality of pixels is connected to a power supply and can be operated independent of the other pixels. Each of the plurality of pixels can include one or more first electrodes disposed over the substantially transparent substrate, wherein each of the one or more first electrodes comprises a substantially transparent conductive material. Each of the plurality of pixels can also include a light emitting layer disposed over each of the one or more first electrodes and one or more second electrodes disposed over the backing substrate, wherein the one or more second electrodes and the one or more first electrode are disposed at a predetermined gap in a low pressure region. Each of the plurality of pixels can further include one or more nanocylinder electron emitter arrays disposed over each of the one or more second electrodes, the nanocylinder electron emitter array including a plurality of nanocylinder electron emitters disposed in a dielectric matrix and a third electrode disposed over the dielectric matrix, wherein each of the plurality of nanocylinder electron emitters includes a first end connected to the second electrode and a second end positioned to emit electrons.

According to yet another embodiment, there is a method of forming a field emission light emitting device. The method including providing a substantially transparent substrate and forming one or more first electrodes over the substantially transparent substrate, wherein each of the one or more first electrodes comprises a substantially transparent conductive material. The method can also include forming a light emitting layer over each of the one or more first electrodes and forming one or more second electrodes disposed over a backing substrate. The method can further include forming one or more nanocylinder electron emitter arrays over each of the one or more second electrodes, the nanocylinder electron emitter array including a plurality of nanocylinder electron emitters disposed in a dielectric matrix and a third electrode disposed over the dielectric matrix, wherein each of the plurality of nanocylinder electron emitters includes a first end connected to the second electrode and a second end positioned to emit electrons. The method can also include providing a plurality of spacers connecting the substantially transparent substrate to the backing substrate to provide a predetermined gap between the one or more first electrodes and the one or more second electrodes and evacuating and sealing the predetermined gap to provide a low pressure region between the one or more first electrodes and the one or more second electrodes.

Additional advantages of the embodiments will be set forth in part in the description which follows, and in part will be obvious from the description, or may be learned by practice of the invention. The advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

Figure 1:
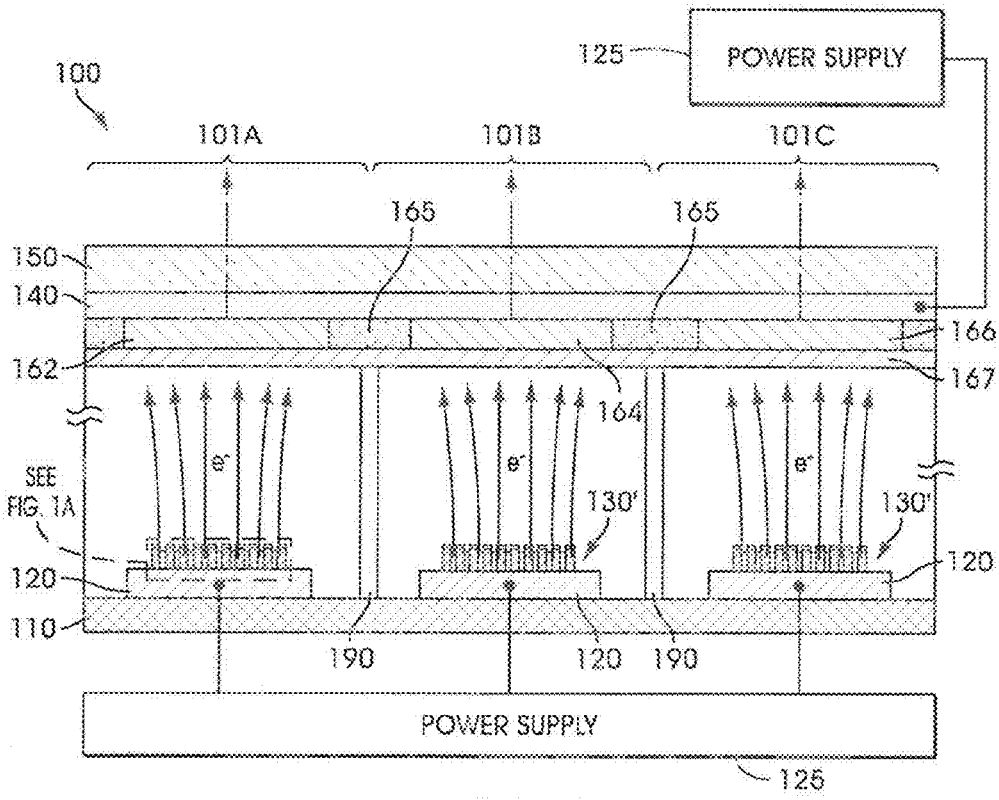
FIGS. 1, 1A, and 2 illustrate exemplary field emission light emitting devices, according to various embodiments of the present teachings.
Figure 2:
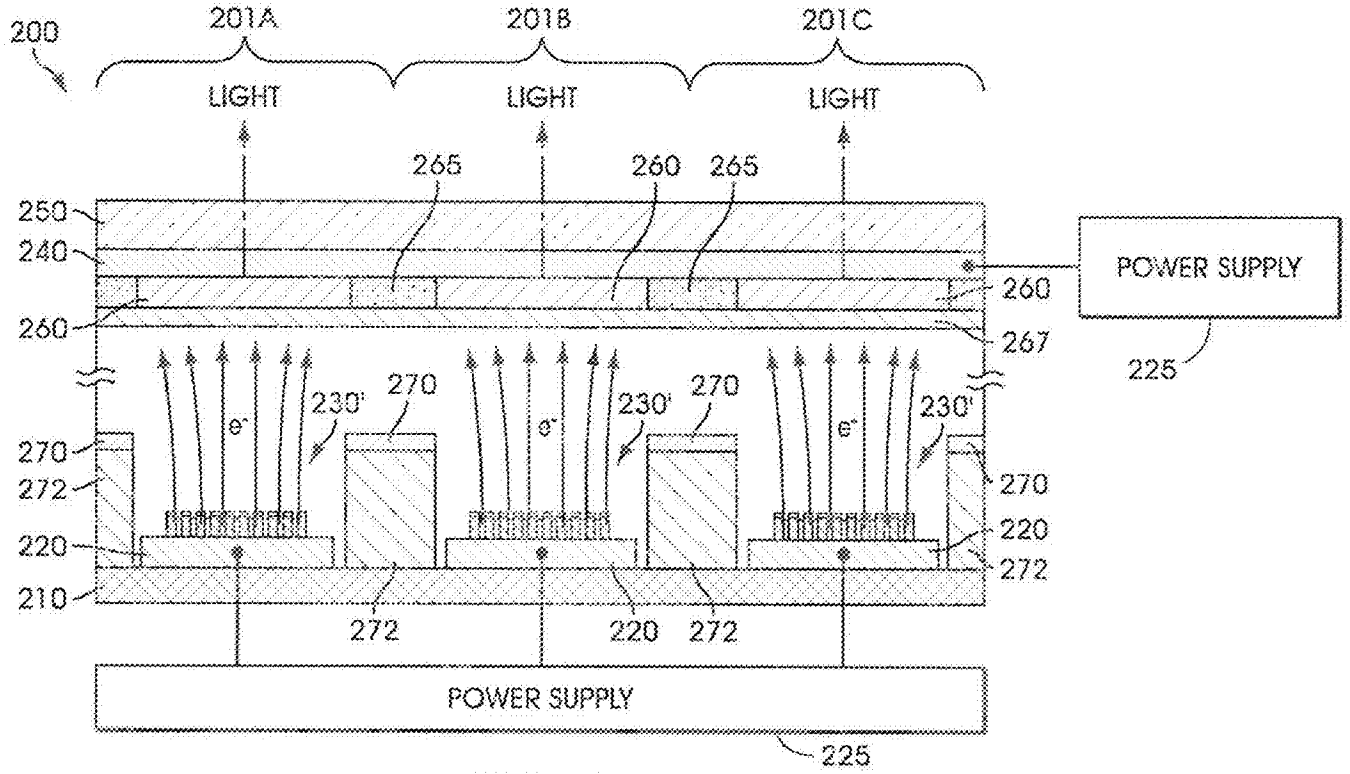

FIGS. 1 and 2 illustrate exemplary field emission light emitting devices (FELED) 100, 200 according to various embodiments of the present teachings. The FELED 100, 200 can include a substantially transparent substrate 150, 250 and a plurality of spacers 190, wherein each of the plurality of spacers 190 can connect the substantially transparent substrate 150, 250 to a backing substrate 110, 210. Any suitable material can be used for the backing substrate 110, 210. As used herein, the term "substantially transparent" refers to having a visible light transmission of at least about 30% or more, and in some cases of least about 50% or more, and in still further cases of at least about 80% or more. Exemplary materials for substantially transparent substrate include, but are not limited to, glass, tinted glass, and clear polymer, such as, for example, polycarbonate. The FELED 100, 200 can also include a plurality of pixels 101A, 101B, 101C, 201A, 201B, 201C wherein each of the plurality of pixels 101A, 101B, 101C, 201A, 201B, 201C can be separated by one or more spacers 190, as shown in FIGS. 1 and 2 wherein each of the plurality of pixels 101A, 101B, 101C, 201A, 201B, 201C can be connected to a power supply 125,225 and can be Operated independent of the other pixels 101A, 101B, 101C, 201A, 201B, 201C, In various embodiments, each of the plurality of pixels 101A, 101B, 101C, 201A, 201B, 201C can include one or more first electrodes 140, 240 disposed over the substantially transparent substrate 150, 250 wherein each of the one or more first electrode 140, 240 can include a substantially transparent conductive material. Exemplary materials for the first electrode 140, 240 can include, but are not limited to indium tin oxide (ITO), vapor deposited titanium, and thin layer of conductive polymers. Each of the plurality of pixels 101A, 101B, 101C, 201A, 201B, 201C can also include a light emitting layer 162, 164, 166, 262, 264, 266 disposed over the one or more first electrodes 140, 240 and one or more second electrodes 120 220 disposed over the backing substrate 110, 210. In various embodiments, the light emitting layer 162, 164, 166, 262, 264, 266 can include a light emitting phosphor material having a light emitting color selected from a group consisting of red, green, blue, and combinations thereof. For example, the light emitting layer 162, 262 can have a red light emitting phosphor material, the light emitting layer 164, 264 can have a green light emitting phosphor material, and the light emitting layer 166, 266 can have a blue light emitting phosphor material. In some embodiments each of the plurality of spacers 190 can include one or more contrast enhancing materials 165. In other embodiments, the FELED 100, 200 can further include a plurality of voltage withstand layers 167, 267, wherein each of the plurality of voltage withstand layers 167, 267 can be disposed over the light emitting layer 162, 164, 166, 262, 264, 266.

Figure 1A:
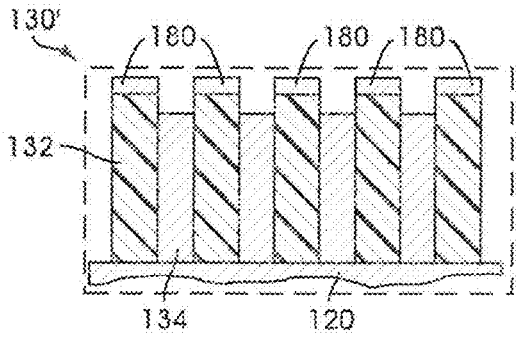

As shown in FIGS. 1 and 2, each of the plurality of pixels 101A, 101B, 101C, 201A, 201B, 201C can further include one or more nanocylinder electron emitter arrays 130', 230' disposed over each of the one or more second electrodes 120, 220. As shown in FIG. 1A, each of the one or more nanocylinder electron emitter arrays 130' can include a plurality of nanocylinder electron emitters 134 disposed in a dielectric matrix 132 such that an average nanocylinder electron emitter 134 to nanocylinder electron emitter 134 distance can be at least about one and a half times an average diameter of the nanocylinder electron emitter. Each of the one or more nanocylinder electron emitter arrays 130' can also include a third electrode 180 disposed over the dielectric matrix 132 such that a distance between the third electrode 180 and the second end of the nanocylinder electron emitter 134 can be less than about five times the diameter of the nanocylinder electron emitter 134. In some embodiments, each of the plurality of nanocylider electron emitters 134 can have an aspect ratio of more than about 2. In various embodiments, the nanocylinder electron emitter array 130' can have an areal density of more than about $10^9$ cylinders/$cm^2$. U.S. patent application Ser. No. 12/041,870 describes in detail the nanocylinder electron emitters, the disclosure of which is incorporated by reference herein in its entirety.

In some embodiments, each of the plurality of second electrodes 120, 220 and nanocylinder electron emitters 134 can include any metal with a low work function, including, but not lit limited to, molybdenum and tungsten. In other embodiments, each of the plurality of second electrodes 120, 220 can include any suitable doped semiconductor. In various embodiments, the dielectric matrix 132 can include one or more materials selected from a group consisting of a polymer, a block co-polymer, a polymer blend, a crosslinked polymer, a track-etched polymer, and an anodized aluminium. In various embodiments, the one or more second electrodes 120, 220 and the first electrode 140, 240 can be disposed at a predetermined gap in a low pressure region. Any suitable material can be used for the third electrode layer 180.

The FELED 100 can be driven by applying suitable voltages to the one or more of the first electrodes 140 and the plurality of the second electrodes 120. In some embodiments, a negative voltage from about 1 V to about 100 V can be applied to the second electrode 120, a voltage of about 0 V can be applied to the third electrode, and a positive voltage from about 10 V to about 1000 V can be applied to the first electrode 140. The voltage difference between the second electrode 120 and the first electrode 140 can create a field around the nanocylinder electron emitters 134, so that electrons can be emitted. The electrons can then be guided by the high voltage applied to the first electrode 140 to bombard the light emitting layer 162, 164, 166 disposed over the first electrode 140. As a result of electron bombardment, the light emitting layer 162, 164, 166 can emit light. In various embodiments, the FELED 100 can also include a light emitting layer 162, 164, 166 with an on-off control. In an exemplary on-off control, a constant voltage can be applied to the first electrode 140, while only desired second electrodes 120 can be supplied with a voltage to emit electrons and as a result light can be emitted only from the desired pixels.

In some embodiments, the FELED 100, 200 can include a plurality of fourth electrodes 270 disposed above the second electrodes 220; as shown in FIG. 2. In various embodiments, each of the plurality of fourth electrodes 270 can include any suitable conductive material. In some embodiments, the fourth electrode 270 can be disposed over a dielectric layer 272. In various embodiments, the plurality of fourth electrodes 270 can be disposed below the plurality of second electrodes 220 (not shown). In various embodiments, the FELED 200, as shown in FIG. 2 can be driven by applying a negative voltage from about 1 V to about 10 V to the second electrode 220, a voltage of about 0 V to the third electrode, a suitable voltage to the fourth electrode 270 depending on whether the plurality of fourth electrodes 270 are positioned above or below the plurality of second electrodes 220, and a positive voltage from about 10 V to about 1000 V to the first electrode 240. Furthermore, in this embodiment, the electrons emitted by the nanocylinder electron emitters 134 due to the voltage difference between the second electrode 220 and the fourth electrode 270, are pushed by the fourth electrode 270.

Figure 3:
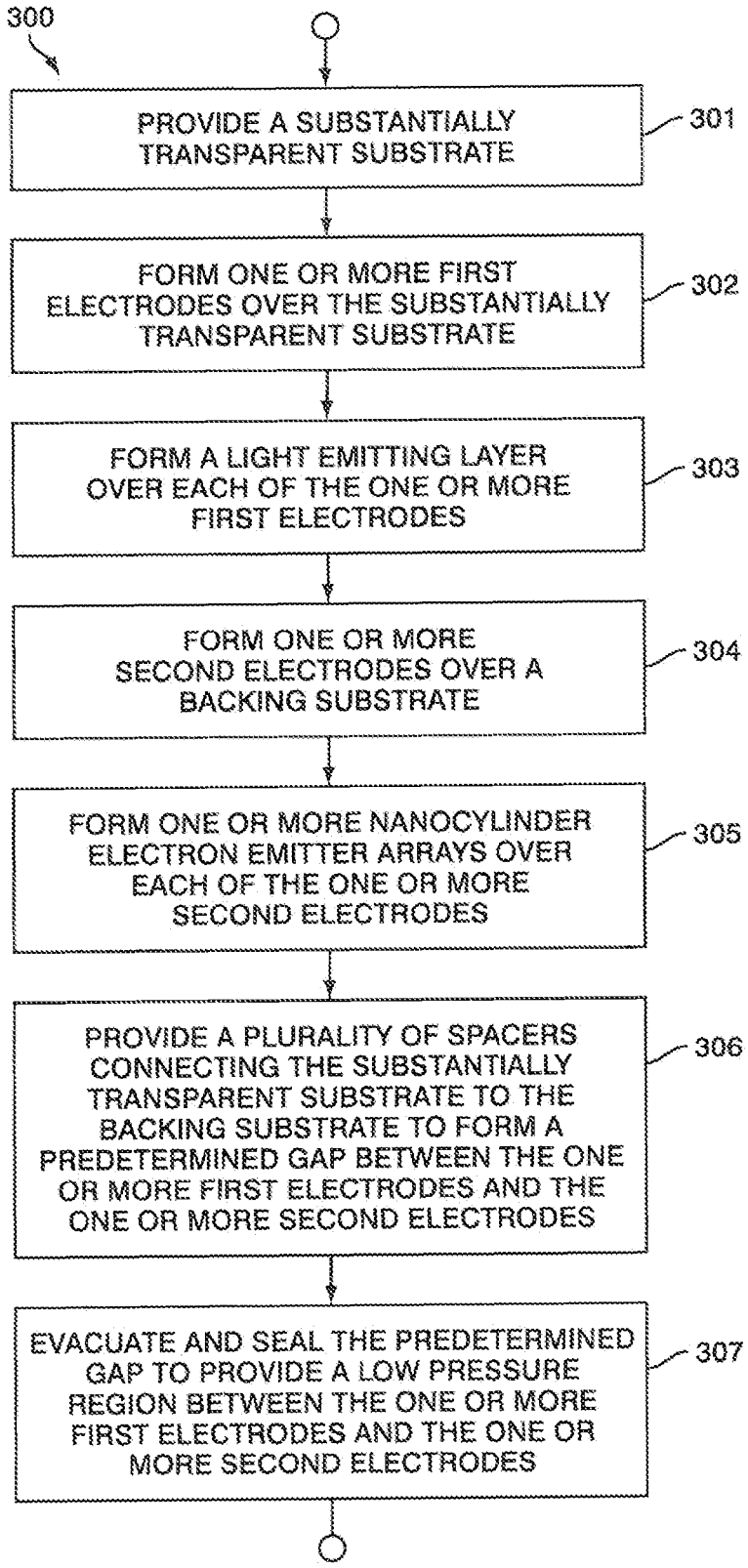
FIG. 3 illustrates an exemplary method of making a field emission light emitting device, in accordance with the present teachings.

According to various embodiments, there is a method 300 of forming a field emission light emitting device 100, 200, as shown in FIG. 3. The method 300 can include providing a substantially transparent substrate 150, as in step 301 and forming one or more first electrodes 140 over the substantially transparent substrate 150, as in step 302, wherein each of the one or more first electrodes 140 includes a substantially transparent conductive material. The method can further include forming a light emitting layer 162, 164, 166 over each of the one or more first electrodes 140, as in step 303 and a step 304 of forming one or more second electrodes 120 over a backing substrate 110. In various embodiments, the method 300 can also include forming a contrast matrix layer 165 over the one or more first electrodes 140 and in close proximity to the light emitting layers 162, 164, 166. The method 300 can also include step 305 of forming one or more nanocylinder electron emitter arrays 130' over each of the one r more second electrodes 120. In various embodiments, the nanocylinder electron emitter array 130' can include a plurality of nanocylinder electron emitters 134 disposed in a dielectric matrix 132 and a third electrode 180 disposed over the dielectric matrix 132, as shown in FIG. 1A, wherein each of the plurality of nanocylinder electron emitters 134 can include a first end connected to the second electrode 120 and a second end positioned to emit electrons. Any suitable method can be used for forming one or more nanocylinder electron emitter arrays 130' over the second electrode 120 such as, for example, polymer template method, self-assembly of nanoparticles, arc discharge, pulsed laser deposition, chemical vapor deposition, electrodeposition, and electroless deposition.

Figure 4A:
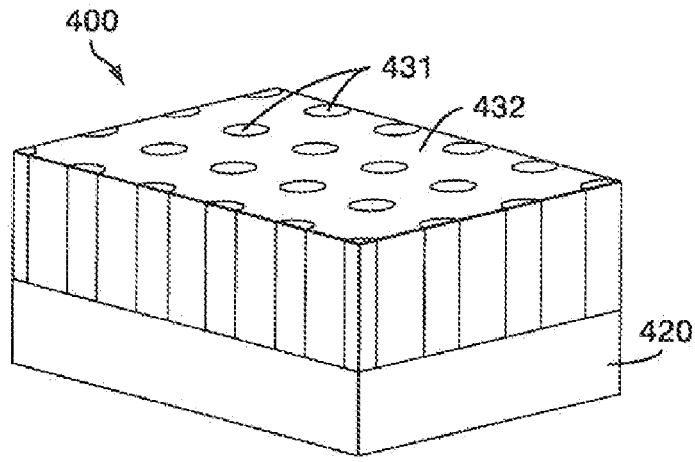
FIGS. 4A-4D show an exemplary method of forming one or more nanocylinder electron emitter arrays by polymer template method, it accordance with the present teachings.
Figure 4B:
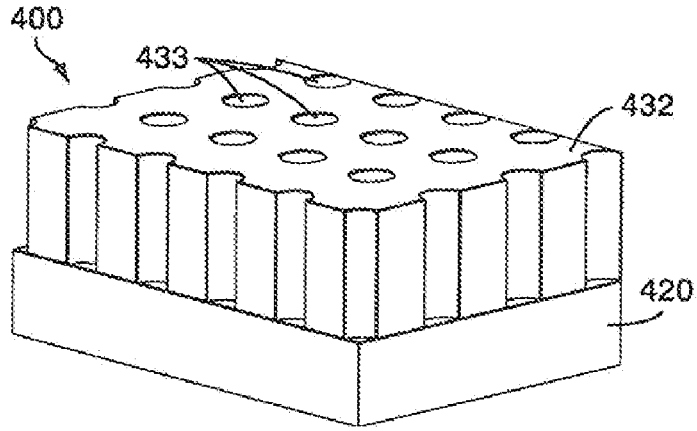
Figure 4C:
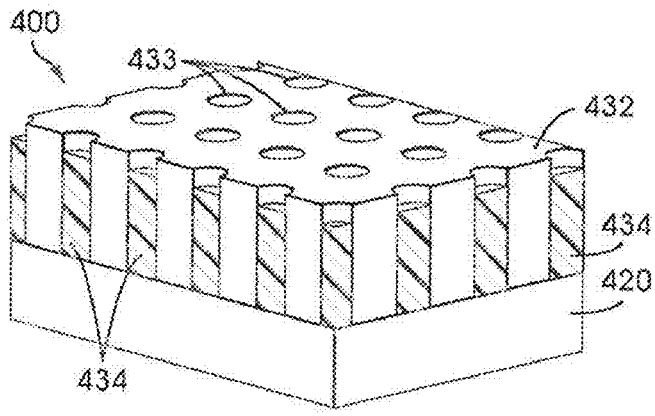
Figure 4D:
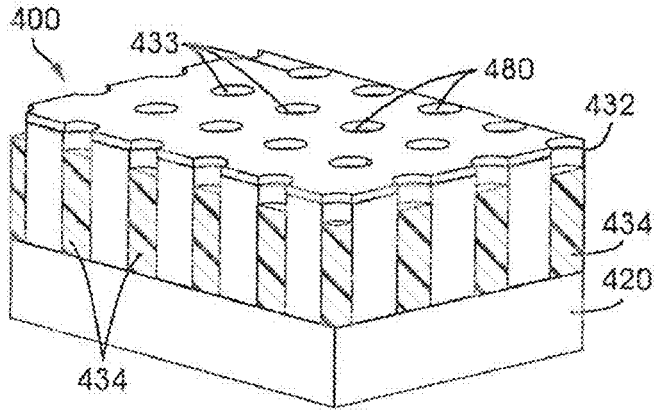
Figure 5A:
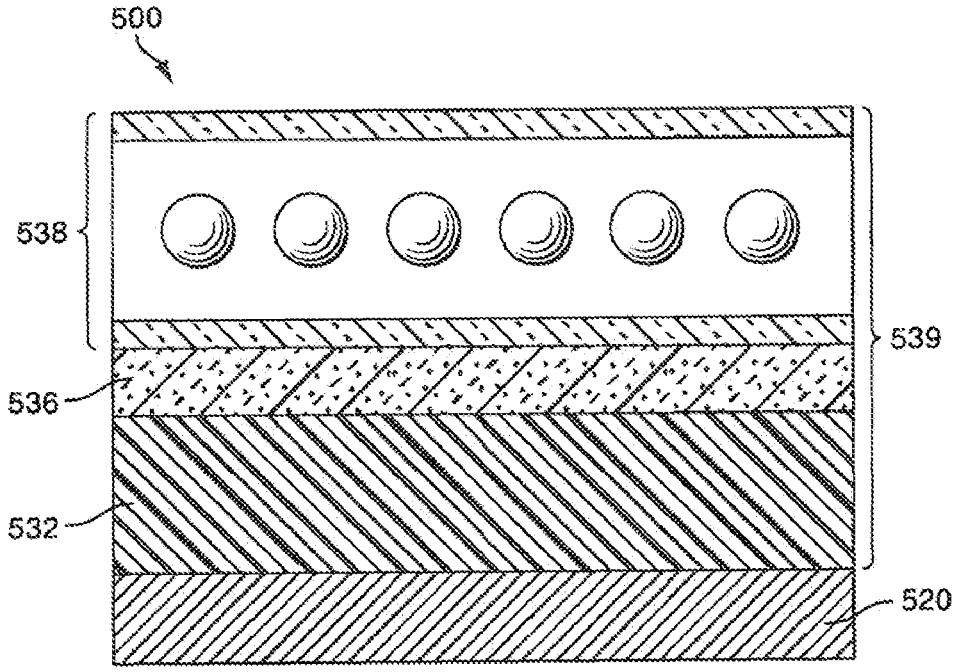
FIGS. 5A-5G show an exemplary method of forming one or more nanocylinder electron emitter arrays using sphere forming diblock copolymer/homopolymer blend and nanolithography, in accordance with the present teachings.
Figure 5B:
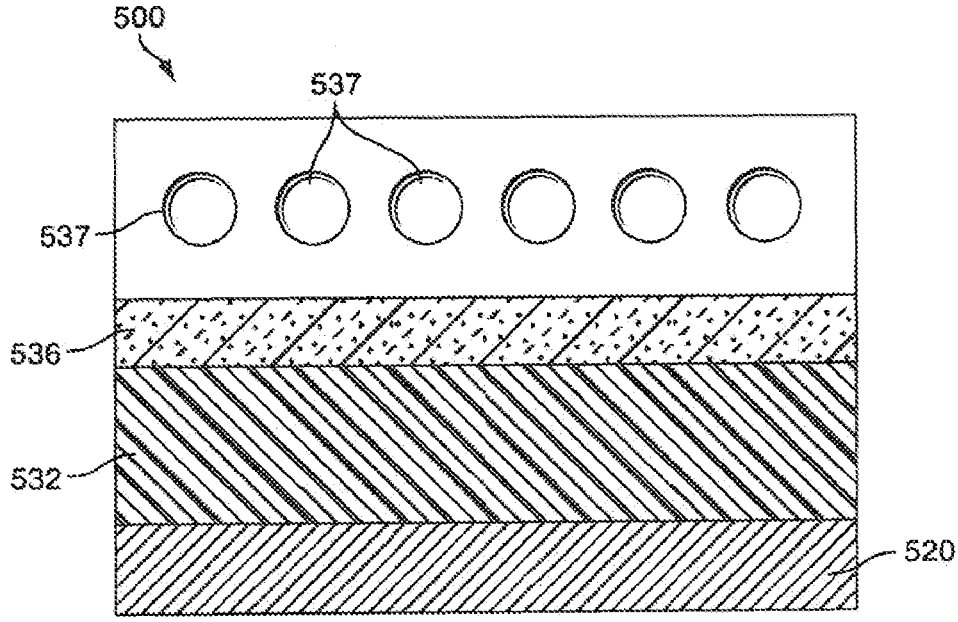
Figure 5C:
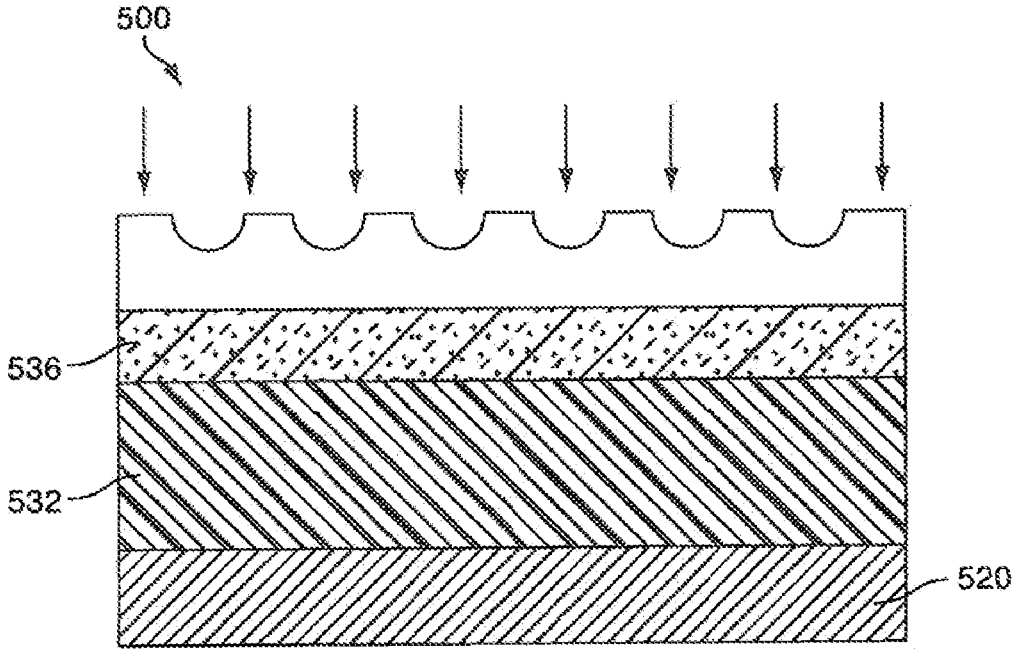
Figure 5D:
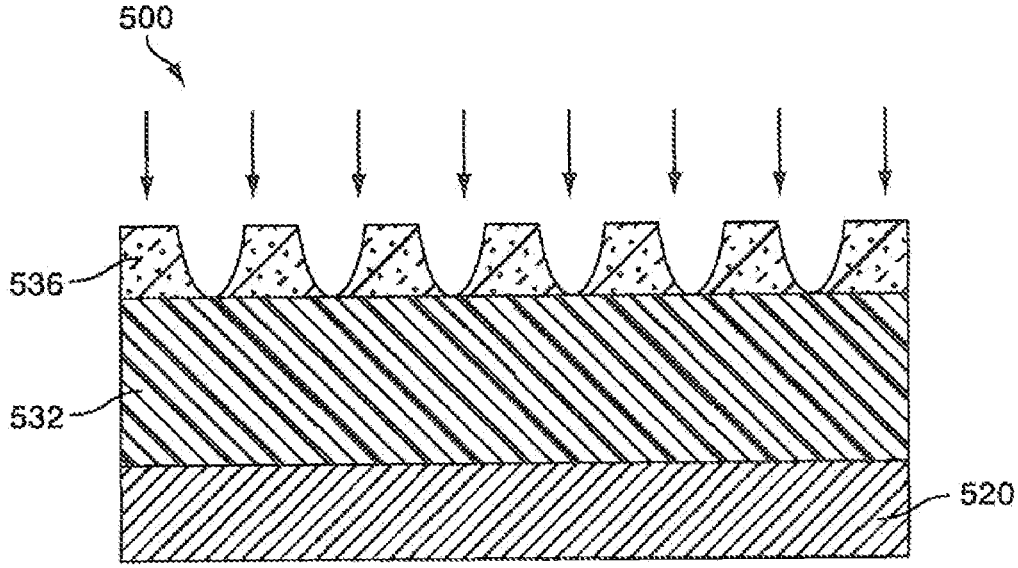
Figure 5E:
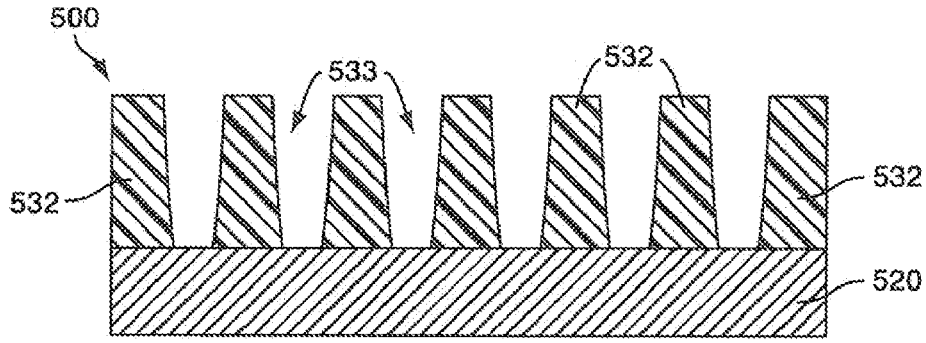
Figure 5F:
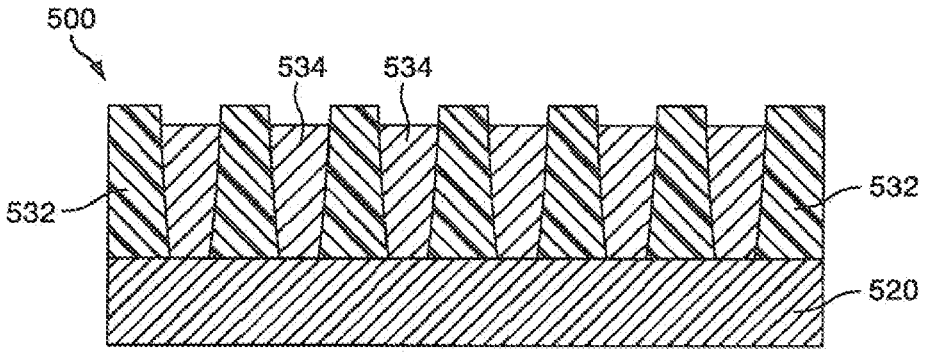
Figure 5G:
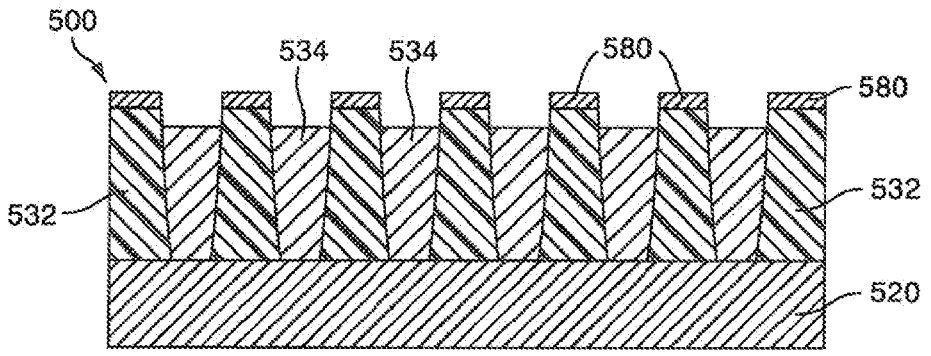

In various embodiments, the step 305 of forming one or more nanocylinder electron emitter arrays 130' over the second electrode 120 can include forming one or more nanocylinder electron emitter arrays 130' by polymer template method 400, as shown in FIGS. 4A-4D. The polymer template method 400 can include a first step of forming a polymer layer 432 over the second electrode 420, the polymer layer 432 including a plurality of cylindrical domains of a block co-polymer 431 and orienting the plurality of cylindrical domains of the block co-polymer 431 to form an array of cylindrical domains of the block co-polymer 431 perpendicular to the second electrode 420, as shown in FIG. 4A. The polymer template method 400 can also include removing the plurality of cylindrical domains of the block co-polymer 431 from the polymer layer 432 to form a plurality of cylindrical nanochannels 433, as shown in FIG. 4. The polymer template method 400 can further include filling the plurality of cylindrical nanochannels 433 with one or more of metals, doped metals, metal alloys, metal oxides, doped metal oxides, and ceramics to form a plurality of nanocylinder electron emitters 434 disposed in the polymer layer 432, as shown in FIG. 4C. The polymer template method 400 can also include forming a third electrode 480 over the polymer layer 432, as shown in FIG. 4D. In some embodiments, the step of forming the third electrode 480 can include depositing a thin layer of conductive material over the polymer layer 432 before the step of removing the plurality of cylindrical domains of the block co-polymer 431 from the polymer layer 432 and removing the thin layer of conductive material over the plurality of cylindrical domains of the block co-polymer 431 along with the plurality of cylindrical domains of the block co-polymer 431.

In various embodiments, the step 305 of forming one or more nanocylinder electron emitter arrays 130' over the second electrode 120 can include forming one or more nanocylinder electron emitter arrays 130' by polymer template method 400, as shown in FIGS. 4A-4D. The polymer template method 400 can include a first step of forming a polymer layer 432 over the second electrode 420, the polymer layer 432 including a plurality of cylindrical domains of a block co-polymer 431 and orienting the plurality of cylindrical domains of the block co-polymer 431 to form an array of cylindrical domains of the block co-polymer 431 perpendicular to the second electrode 420, as shown in FIG. 4A. The polymer template method 400 can also include removing the plurality of cylindrical domains of the block co-polymer 431 from the polymer layer 432 to form a plurality of cylindrical nanochannels 433, as shown in FIG. 4B. The polymer template method 400 can further include filling or only partially filling the plurality of cylindrical nanochannels 433 with one or more of metals, doped metals, metal alloys, metal oxides, doped metal oxides, and ceramics to form a plurality of nanocylinder electron emitters 434 disposed in the polymer layer 432, as shown in FIG. 4C. As further depicted in FIG. 4C, each nanocylinder electron emitter physically contacts the polymer layer 432 dielectric matrix. The polymer template method 400 can also include forming a third electrode 480 over the polymer layer 432, as shown in FIG. 4D. In some embodiments, the step of forming the third electrode 480 can include depositing a thin layer of conductive material over the polymer layer 432 before the step of removing the plurality of cylindrical domains of the block co-polymer 431 from the polymer layer 432 and removing the thin layer of conductive material over the plurality of cylindrical domains of the block co-polymer 431 along with the plurality of cylindrical domains of the block co-polymer 431.

In some embodiments, the method 300 can also include forming a plurality of pixels 101A 101B, 101C, as shown in FIG. 1, wherein each of the plurality of pixels 101A, 101B, 101C can be separated by the one or more spacers 190. In some embodiments, each of the plurality of pixels 101A, 101B, 101C can include one or more first electrodes 140 disposed over the substantially transparent substrate 150, a light emitting layer 162, 164, 166 disposed over each of the one or more first electrodes 140, one or more second electrodes 120 over the backing substrate 110, one or more nanocylinder electron emitter arrays 130' disposed over each of the one or more second electrodes 120. The method 300 can further include providing a power supply 125, wherein each of the plurality of pixels 101A, 101B, 101C is connected to the power supply and is operated independent of the other pixels.

Referring back to the method 300 of forming a field emission light emitting device 100, 200, the method 300 can further include a step 306 of providing a plurality of spacers 190 connecting the substantially transparent substrate 150 to the backing substrate 110 to form a predetermined gap between the one or more first electrodes 150 and the one or more second electrodes 120, as shown in FIG. 1. The method 300 can also include evacuating and sealing the predetermined gap to provide a low pressure region between the one or more first electrodes 140 and the one or more second electrodes 120, as in step 307. In various embodiments, the method 300 can further include forming one or more fourth electrodes 270 over the backing substrate 210, as shown in FIG. 2.

In some embodiments, the method 300 can also include forming a plurality of pixels 101A, 101B, 101C, as shown in FIG. 1, wherein each of the plurality of pixels 101A, 101B, 101C can be separated by the one or more spacers 190. In some embodiments, each of the plurality of pixels 101A, 101B, 101C can include one or more first electrodes 140 disposed over the substantially transparent substrate 150, a light emitting layer 162, 164, 166 disposed over each of the one or more first electrodes 140, one or more second electrodes 120 over the backing substrate 110, one or more nanocylinder electron emitter arrays 130' disposed over each of the one or more second electrodes 120. The method 300 can further include providing a power supply (not shown), wherein each of the plurality of pixels 101A, 1016, 101C is connected to the power supply and is operated independent of the other pixels.

In various embodiments, the FELED 100, 200 can be an erase bar, or an imager in a digital electrophotographic printer. In some embodiments, the FELED 100, 200 can be a flexible, light weight, low power ultra thin display panel.

While the invention has been illustrated respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the phrase "one or more of A, B, and C" means any of the following: either A, B, or C alone; or combinations of two, such as A and B, B and C, and A and C; or combinations of three A, B and C.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A field emission light emitting device comprising:

a substantially transparent substrate;

a plurality of spacers, wherein each of the plurality of spacers, connects the substantially transparent substrate to a backing substrate; and a plurality of pixels, each of the plurality of pixels separated by one or more spacers, wherein each of the pixels of the plurality of pixels comprises:

one or more first electrodes disposed over the substantially transparent substrate, wherein each of the one or more first electrodes comprises a substantially transparent conductive material;

a light emitting layer disposed over each of the one or more first electrodes;

one or more second electrodes disposed over the backing substrate; and one or more nanocylinder electron emitter arrays disposed over each of the one or more second electrodes, the nanocylinder electron emitter array comprising a plurality of nanocylinder electron emitters disposed in a dielectric matrix, and spaced apart from adjacent emitters of the pixel by the dielectric matrix, the dielectric matrix comprising an upper surface and a plurality of openings therein, and a third electrode disposed on the dielectric matrix and comprising a plurality of openings therein, wherein each of the plurality of nanocylinder electron emitters is within one of the plurality of openings in the dielectric matrix, physically contacts the dielectric matrix, and comprises a first end connected to the second electrode and a second end positioned to emit electrons, and the second end of each nanocylinder electron emitter is recessed below the upper surface of the dielectric matrix and exposed by one of the plurality of openings in the dielectric matrix and by one of the plurality of openings in the third electrode.

2. The field emission light emitting device of claim 1, wherein each of the plurality of nanocylinder electron emitters has an aspect ratio of more than about 2.

3. The field emission light emitting device of claim 1, wherein the plurality of nanocylinder electron emitters are disposed in the dielectric matrix such that an average distance from one nanocylinder electron emitter to another nanocylinder electron emitter is at least about one and a half times an average diameter of the nanocylinder electron emitter.

4. The field emission light emitting device of claim 1, wherein the dielectric matrix comprises one or more materials selected from a group consisting of a polymer, a block co-polymer, a polymer blend, a crosslinked polymer, a track-etched polymer, and an anodized aluminium.

5. The field emission light emitting device of claim 1, wherein the third electrode is disposed over the dielectric matrix such that a distance between the third electrode and the second end of the nanocylinder electron emitter is less than about five times the diameter of the nanocylinder electron emitter.

6. The field emission light emitting device of claim 1, wherein each of the plurality of pixels, further comprises one or more fourth electrodes disposed over the backing substrate.

7. The field emission light emitting device of claim 1, wherein the light emitting layer comprises a light emitting phosphor material having a light emitting color selected from a group consisting of red, green, blue, and combinations thereof.

8. The field emission light emitting device of claim 1 further comprising contrast matrix layer disposed over the one or more first electrodes and in close proximity to the light emitting layers.

9. The field emission light emitting device of claim 1 further comprising a plurality of voltage withstand layers, wherein each of the plurality of voltage withstand layers is disposed over the light emitting layer.

10. The field emission light emitting device of claim 1, further comprising:

the plurality of openings in the dielectric matrix are etched openings in the dielectric matrix;

the plurality of openings in the third electrode are etched openings in the third electrode; and the plurality of electron emitters at least partially fill the etched openings in the dielectric matrix.

11. The field emission light emitting device of claim 1, wherein the plurality of electron emitters only partially fill the etched openings in the dielectric matrix.

12. The field emission light emitting device of claim 1, wherein the second end of each nanocylinder is exposed by a different opening of the plurality of openings in the dielectric matrix and by a different opening of the plurality of openings in the third electrode.

13. The field emission light emitting device of claim 1, wherein the one or more second electrodes and the one or more first electrode are disposed at a predetermined gap in a low pressure region and each of the plurality of pixels is connected to a power supply and can be operated independent of the other pixels.

* * * * *